United States Patent [19]

McPhee

[11] Patent Number: 4,913,053

[45] Date of Patent: Apr. 3, 1990

[54] METHOD OF INCREASING THE DETONATION VELOCITY OF DETONATING FUSE

[75] Inventor: William A. McPhee, Jersey Village, Tex.

[73] Assignee: Western Atlas International, Inc., Houston, Tex.

[21] Appl. No.: 182,340

[22] Filed: Apr. 18, 1988

Related U.S. Application Data

[63] Continuation-in-part of Ser. No. 914,836, Oct. 2, 1986, abandoned.

[51] Int. Cl.[4] ..... C06C 5/04

[52] U.S. Cl. ..... 102/275.8; 102/275.1

[58] Field of Search ..... 102/275.1, 275.8, 275.12, 102/322, 285, 275.9, 324; 89/1.15; 86/1.1, 2.2; 264/3.2, 3.3

[56] References Cited

U.S. PATENT DOCUMENTS

| | | | |
|---|---|---|---|
| 822,154 | 3/1908 | Lheure | 86/22 |
| 871,696 | 11/1907 | Herr | 102/275.1 |
| 2,953,443 | 9/1960 | Lloyd | 102/275.9 |
| 3,028,274 | 4/1962 | Winer | 264/3.3 |
| 3,049,079 | 8/1962 | Eilo | 102/324 |
| 3,621,559 | 11/1971 | Welsh | 102/275.9 |
| 3,760,728 | 9/1973 | McKee et al. | 102/324 |
| 3,903,800 | 9/1975 | Kilmer | 86/1.1 |
| 3,907,947 | 9/1975 | Neuhaus et al. | 86/1.1 |
| 3,954,062 | 5/1976 | Dunlap et al. | 102/275.1 |
| 3,966,236 | 6/1976 | Vann | 285/39 |
| 3,968,724 | 7/1976 | Kowalick et al. | 102/275.1 |
| 3,981,222 | 9/1976 | Bowman | 86/22 |
| 3,991,565 | 11/1976 | Gordon et al. . | |
| 4,066,282 | 1/1978 | Vann | 285/39 |
| 4,090,342 | 5/1978 | Rishel | 102/324 |
| 4,177,732 | 12/1979 | Steele | 86/1.1 |
| 4,461,213 | 7/1984 | Autret et al. | 102/335 |
| 4,491,185 | 1/1985 | McClure | 175/4.56 |
| 4,601,492 | 7/1986 | George | 285/3 |
| 4,716,832 | 1/1988 | Sumner | 102/275.1 |

FOREIGN PATENT DOCUMENTS

| | | | |
|---|---|---|---|
| 570515 | 2/1959 | Canada | 264/3.2 |
| 2278659 | 2/1976 | France | 264/3.2 |

*Primary Examiner*—Charles T. Jordan
*Assistant Examiner*—Stephen Johnson
*Attorney, Agent, or Firm*—Patrick H. McCollum

[57] ABSTRACT

A method of increasing the detonation velocity of explosive detonating fuse by subjecting it to elevated temperatures and pressure is disclosed. Detonation fuse is subjected to temperature in the range 225° F. to 250° F. with pressures in the range of 10,000 psi to 20,000 psi for a time duration in the range of 30–60 minutes.

6 Claims, 1 Drawing Sheets

METHOD OF INCREASING THE DETONATION VELOCITY OF DETONATING FUSE

RELATED U.S. APPLICATION

This application is a continuation-in-part of U.S. patent application Ser. No. 914,836, filed Oct. 2, 1986 (now abandoned).

BACKGROUND OF THE INVENTION

This invention is concerned with a method of increasing the detonation velocity of detonating fuse having an explosive core and a covering surrounding the explosive core. Detonating fuse has many applications in explosive work and is an integral component of many types of downhole well perforating guns. Such detonating fuse consists of an explosive core, typically of cyclotrimethelen trinitramine (RDX), with a textile or plastic covering. Detonating fuse of this type is commercially available from Ensign-Brickford under the mark Primacord.

In a perforating gun, the detonating fuse is strung the length of the gun and is connected to the rear of each of the charges mounted on a bar, or charge carrier. Detonation of the detonating fuse is designed to detonate each of the charges simultaneously by transferring an explosive detonation wave through the detonating fuse. When the charges don't fire simultaneously, those which detonate first hinder the effectiveness of those charges which detonate later, and in some cases prevent altogether the detonation of subsequent charges. Lack of substantially simultaneous charge detonation drastically reduces the extent and efficiency of perforating the stratum.

Lack of substantially simultaneous charge firing commonly results from failure of the detonating fuse, upon detonation, to furnish a shock wave of sufficient velocity to initiate the firing of each of the charges. Sometimes the detonating fuse as manufactured, simply lacks sufficient detonating velocity. In other situations, however, the direct exposure of the detonating fuse, when used in the bar gun application, to the elevated temperature and pressure found in the borehole of a well can significantly lower the effective velocity attained by such detonating fuse upon detonation. The elevated downhole temperature and pressure cause shrinkage of the covering of the detonating fuse, and the resulting pinching, kinks and crimps therein reduce effective detonation velocity.

A method of increasing the detonation velocity of detonating fuse is therefore especially useful in downhole applications to be able to consistently achieve simultaneous detonation of all charges in a perforating gun.

SUMMARY OF THE INVENTION

For the purpose of increasing the density of detonating fuse, and thus its detonation velocity, the detonating fuse is subjected to heat of 225° F. (107° C.) to 250° F. (121° C.) and pressure of 10,000 psi to 20,000 psi for a time duration of 30–60 minutes.

DESCRIPTION OF THE PREFERRED EMBODIMENT

Figure 1A:
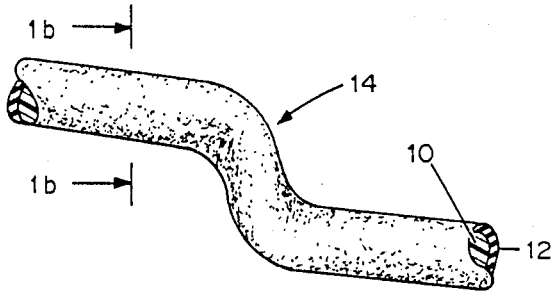
FIGS. 1*a* and 1*b* generally illustrate a section of detonating cord and a transverse cross-section thereof showing the explosive core surrounded by a covering.
Figure 1B:
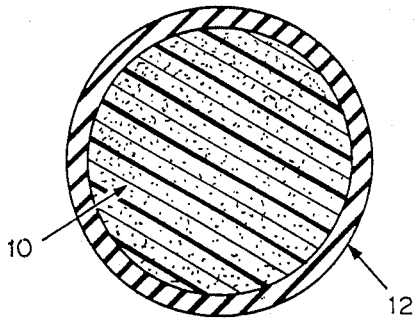

Detonating fuse such as the type shown in FIGS. 1*a* and 1*b* may be comprised of an explosive core 10 surrounded by a pliable covering 12. The explosive core 10 may be a cylindrical string 14 which in turn is enclosed by a heat shrinkable tubing or wrapping 12. Such detonating cord is available through Ensign-Bickford under the name PRIMACORD. As the cord comes from the manufacturer, characteristics such as detonation velocity are predetermined. In certain applications it is desirable to increase the detonation velocity of such detonating cord. An example of such a modification is in perforating guns used in the development of an oil well.

Figure 2:
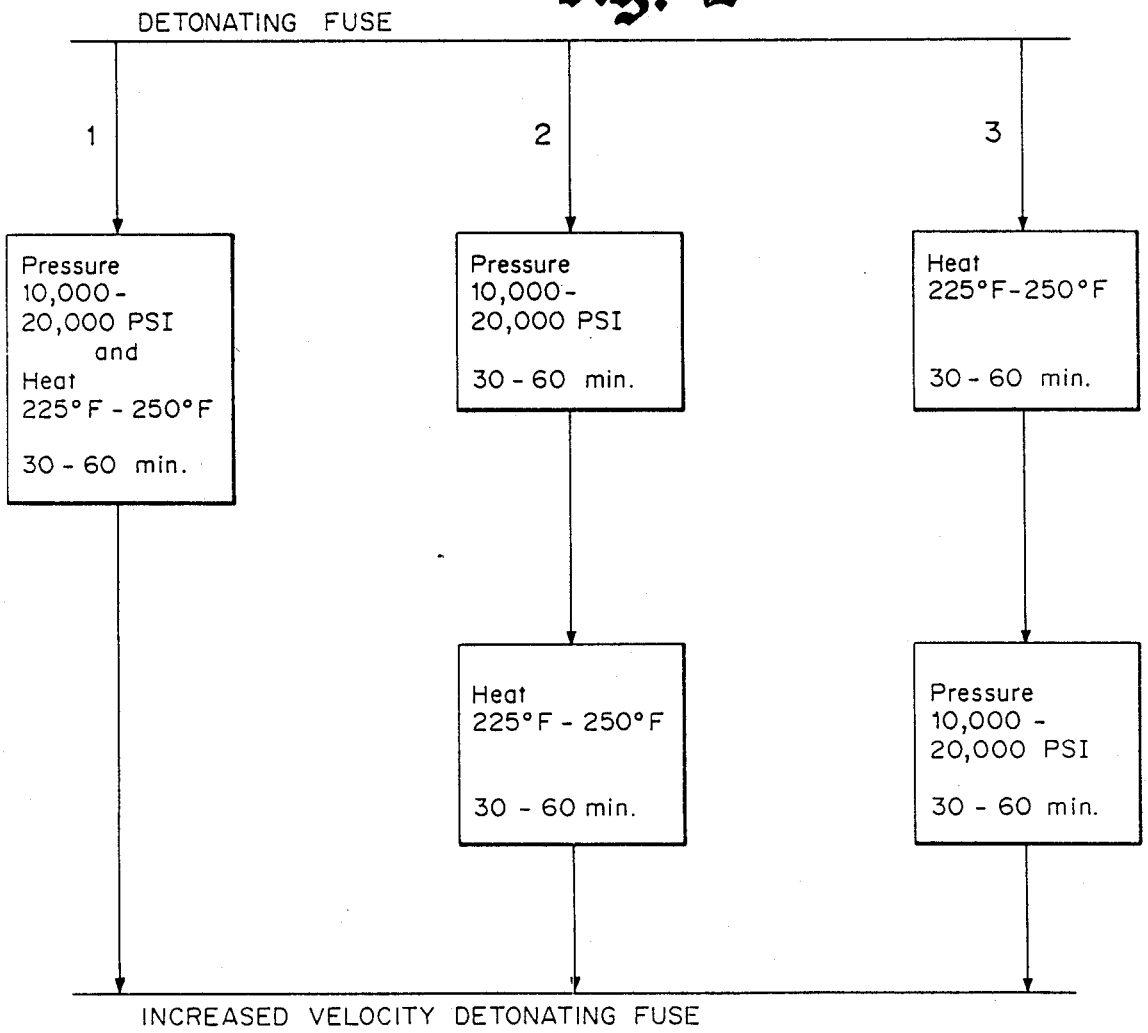
FIG. 2 is a flow chart, in block diagram form, showing the steps to be performed in practicing the invention in three illustrated alternative process paths.

The method described for increasing the detonation velocity of detonating fuse involves subjecting the fuse to selected elevated temperature and pressure ranges. This process can be conducted in accordance with any one of the three alternative process paths shown in FIG. 2. Those skilled in the art will be familiar with the type of pressure cylinder and oven which could be used for such purpose.

As the detonation velocity of detonating fuse is principally a function of its density, it has been found that subjecting the fuse to elevated temperatures and pressures increases the density of the explosive core and shrank the covering and thus increase its velocity. Subjecting detonating fuse as received from the manufacturer to a pressure greater than one atmosphere, or more specifically to 10,000–20,000 psi of pressure, and heating it to between 225° F. and 250° F., for 30 to 60 minutes, eliminates the 6–10% shrinkage of the covering which would otherwise occur in the borehole, and increases the density of the explosive core to increase the detonation velocity of the explosive detonating fuse by 15–20%.

The embodiments of the invention in which an exclusive property or privilege is claimed are defined as follows:

1. A method for increasing a detonation velocity of an explosive detonating fuse having a core and a heat shrinkable cover, comprising the steps of:

exposing said explosive detonating fuse to heat sufficient to raise a temperature of the detonating ufse core and heat shrinkable cover above 225° F.

exposing said explosive detonating fuse to a pressure greater than 10,000 pounds per square inch yet less than 20,000 pounds per square inch; and maintaining the exposure of the explosive detonating fuse to the heat and pressure for 30 for 60 minutes.

2. A method for increasing a detonation velocity of an explosive detonating cord having a core and a sheath, comprising the steps of:

compacting said core and sheath under a pressure between 10,000 and 20,000 pounds per square inch for 30 to 60 minutes; and shrinking said sheath about said core by heating said explosive detonating cord to a temperature between 225 and 250 degrees Fahrenheit for 30 to 60 minutes.

3. The method as defined in claim 2, wherein compacting the core occurs prior to heating.

4. The method as defined in claim 2, wherein heating occurs prior to compacting.

5. The method as defined in claim 2, wherein heating and compacting are conducted simultaneously.

6. A method for increasing a detonation velocity of an explosive cord have a core and a covering about said core comprising the step of compacting said core and the covering about the core by subjecting said cord to heat and pressure between 225 and 250 degrees Fahrenheit, and 10,000 and 20,000 pounds per square inch, respectively for a period between 30 and 60 minutes.

* * * * *